US005161501A

United States Patent [19]

Hu

[11] Patent Number: 5,161,501

[45] Date of Patent: Nov. 10, 1992

[54] SELF-CLIPPPING SLAVE PISTON

[75] Inventor: Haoran Hu, Windsor, Conn.

[73] Assignee: Jacobs Brake Technology Corporation, Wilmington, Del.

[21] Appl. No.: 816,665

[22] Filed: Jan. 3, 1992

[51] Int. Cl.[5] ..... F02D 13/04

[52] U.S. Cl. ..... 123/324; 123/321

[58] Field of Search ..... 123/321, 324; 92/107, 92/187, 130 R, 179

[56] References Cited

U.S. PATENT DOCUMENTS

| | | | |
|---|---|---|---|
| 2,847,261 | 8/1958 | Cornelius | 92/179 |
| 3,220,392 | 11/1965 | Cummins | 123/97 |
| 3,405,699 | 10/1968 | Laas | 123/320 |
| 4,381,179 | 4/1983 | Pareja | 92/187 |
| 4,399,787 | 8/1983 | Cavanagh | 123/321 |
| 4,423,712 | 1/1984 | Mayne | 123/321 |
| 4,592,319 | 6/1986 | Meistrick | 123/321 |
| 4,741,307 | 5/1988 | Meredy | 123/321 |
| 5,036,810 | 8/1991 | Meneely | 123/321 |

*Primary Examiner*—Raymond A. Nelli

*Attorney, Agent, or Firm*—Robert R. Jackson; G. Victor Treyz

[57] ABSTRACT

An improved slave piston for use in a compression release engine retarder is disclosed. The piston incorporates a self-clipping mechanism whereby, when appropriate, the escape of the high-pressure fluid that drives the slave piston is allowed, clipping the slave piston's displacement. The apparatus is more robust than previous designs and easier and cheaper to manufacture. In accordance with another feature of the invention, an improved fit is provided between the slave piston and the means for controlling the exit of high pressure hydraulic fluid.

11 Claims, 5 Drawing Sheets

SELF-CLIPPPING SLAVE PISTON

BACKGROUND OF THE INVENTION

This invention relates to compression relief engine retarders, and more particularly to slave pistons in these systems that incorporate a clipping mechanism to limit their maximum displacement.

Engine retarders of the compression relief type are well known in the art. In general, such retarders are designed temporarily to convert an internal combustion engine into an air compressor so as to develop a retarding horsepower which may be a substantial portion of the operating horsepower developed by the engine in its operating mode.

The basic design for an engine retarding system of the type here involved is disclosed in Cummins U.S. Pat. No. 3,220,392. In that design a hydraulic system (which may make use of oil from the associated engine) is employed wherein the motion of a master piston actuated by an appropriate intake, exhaust, or fuel injector push-tube or rocker arm controls the motion of a slave piston. The slave piston opens the exhaust valve of a cylinder of the internal combustion engine near the end of the compression stroke whereby the work done in compressing the air in that cylinder is not recovered during the subsequent expansion or "power" stroke but, instead, is dissipated through the exhaust and cooling systems of the engine.

In this type of retarder it is desirable to provide accurate timing of exhaust valve openings and a well-controlled opening rate and extent. To this end, it is advantageous in these systems to apply sharp hydraulic pulses to the slave pistons so that they open the exhaust valves rapidly. In order to both stop the slave pistons' motion and prevent excessive opening of the associated exhaust valves, reset or "clipping" mechanisms are required that reduce the hydraulic fluid pressure when either the hydraulic fluid pressure reaches a predetermined maximum or the slave pistons have reached the end of their desired stroke.

A typical slave piston design incorporating such a reset mechanism uses a hollow lash-adjusting screw containing a reciprocating plunger that makes a face fit over a hole in the slave piston surface. With this design the travel of the reciprocating plunger is arrested upon contact with a press-fit pin that fits in a slot within the body of the plunger. However, this system is relatively costly to manufacture due to the complex configurations of its various parts, the need to test it to ensure that the pin will not come out, etc. The hollow lash-adjusting screw is also a problem because it may break if tightened excessively.

It is therefore an object of the present invention to provide an improved slave piston clipping apparatus. It is a more particular object of this invention to provide slave pistons which are more robust, easier to manufacture and display rapid clipping rates.

SUMMARY OF THE INVENTION

These and other objects of the invention are accomplished in accordance with the principles of the invention by providing a self-clipping slave piston with a reciprocating valve inside that makes a lap fit with the slave piston walls. This arrangement allows a solid lash adjusting screw to be used, reducing the risk of breakage of this component. The further elimination of the face fit between the reciprocating pin and the slave piston, as was used previously, permits slave pistons designed according to the present invention to exhibit improved performance, and does not necessitate a near-perfect end face match. The present invention also improves upon the older design as it eliminates the need for the press-fit pin.

BRIEF DESCRIPTION OF THE DRAWINGS

Further features of the invention, its nature and various advantages will be more apparent from the following detailed description of the invention and the accompanying drawings in which.

DETAILED DESCRIPTION OF THE PREFERRED EMBODIMENTS

Figure 1:
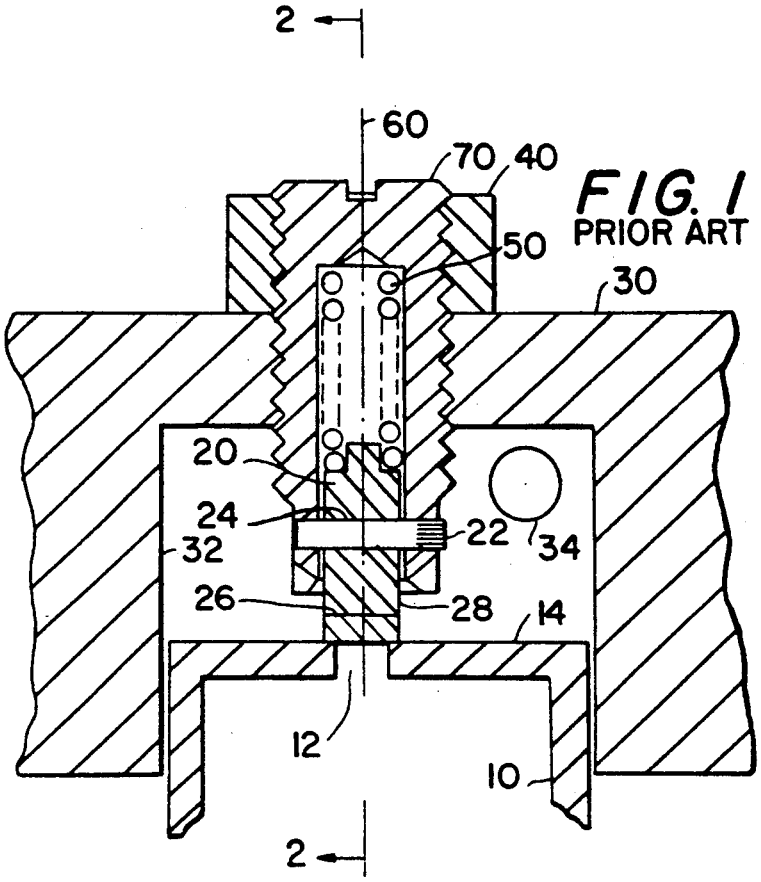
FIG. 1 PRIOR ART
FIG. 1 is a simplified cross-sectional view of a conventional slave piston system.
Figure 2:
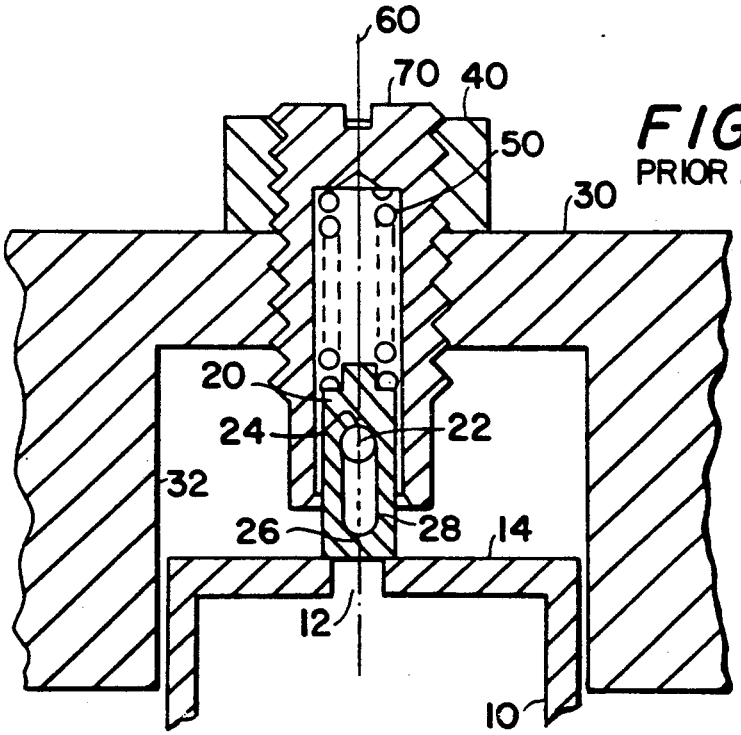
FIG. 2 PRIOR ART
FIG. 2 is a simplified cross-sectional view taken along the line 2—2 in FIG. 1.
Figure 3:
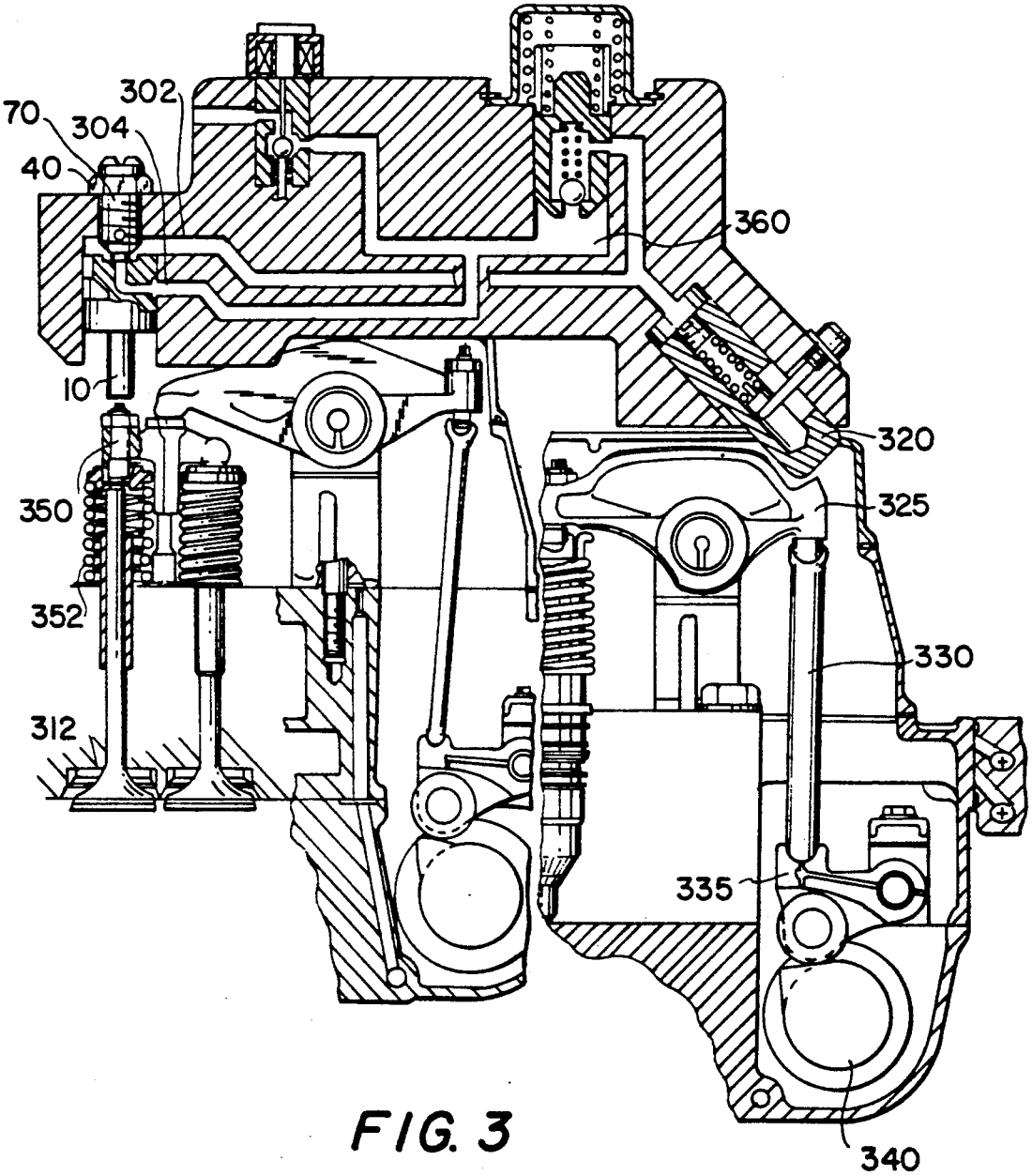
FIG. 3 is a simplified cross-sectional view of a compression relief engine retarder system.
Figure 4:
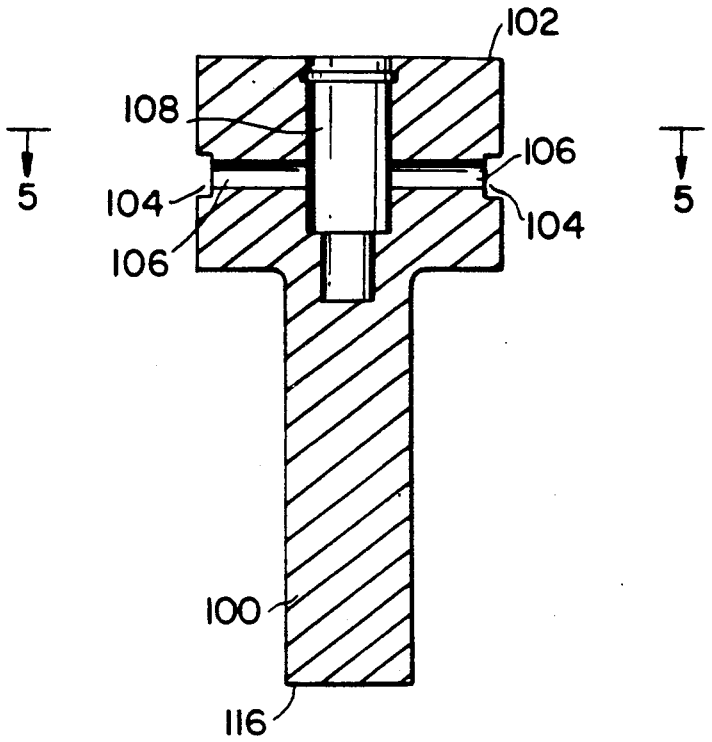
FIG. 4 is a simplified cross sectional view of an illustrative embodiment of the self-clipping slave piston of the present invention.
Figure 5:
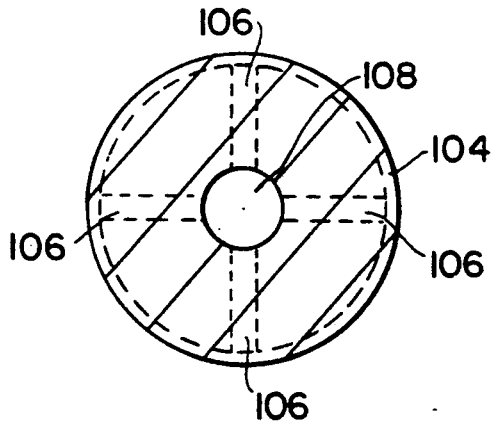
FIG. 5 is a simplified cross sectional view taken along the line 5—5 in FIG. 4.

In the conventional system shown in FIGS. 1 and 2, slave piston 10 reciprocates in slave piston cylinder 32 along longitudinal axis 60 in housing 30. The initial position of slave piston 10 is determined by the adjustment of screw 70, which is held in place against housing 30 by nut 40. The overall operation of the general type of compression relief engine retarder system that uses the present invention is further shown in FIG. 3. In operation a high pressure pulse, generally in the range of 2000–4000 psi, is generated by the rotation of engine injection cam 340, which urges arm 335 to move rocker arm 325 via member 330, urging master piston 320 against the hydraulic fluid in high pressure passage 302 of a hydraulic circuit. This pulse is transmitted through the hydraulic circuit to slave piston cylinder 32 via aperture 34. The force of the pressurized hydraulic fluid against top end face 14 of slave piston 10 causes slave piston 10 to move along longitudinal axis 60 in a downward direction so that slave piston 10 urges member 350 downward, holding open exhaust valve 312. Plunger 20, which reciprocates in the hollow portion of screw 70, has a slot 28 through which pin 22 is inserted. Pin 22 is press-fit into screw 70. The excursion of plunger 20 is determined by the location of pin 22 between the top 24 and the bottom 26 of slot 28. During the downward travel of slave piston 10, plunger 20 is held against aperture 12 of slave piston 10 by spring 50 so as to block the escape of hydraulic fluid until the top 24 of slot 28 comes into contact with pin 22 as shown in FIGS. 1 and 2. Spring 50 has sufficient strength to hold the flat lower end face of plunger 20 against the flat upper surface 14 of slave piston 10, forming a "face fit" between the two end faces.

When top 24 of slot 28 contacts pin 22, slave piston 10 separates from plunger 20. This allows hydraulic fluid to escape from slave piston cylinder 32 through aperture 12 in slave piston 10 and via low pressure passage 304 into recovery area 360, thereby automatically limiting the downward travel of slave piston 10 and the amount by which the associated exhaust valve is opened. When the master piston no longer applies the high pressure pulse, slave piston 10 is driven back up to its initial position by spring 352 via member 350.

Although the conventional slave piston system with the mechanism for clipping the displacement of the slave piston described above is superior to those systems without such capabilities, there is room for improvement of the design. For instance, the operation of press-fitting pin 22 into screw 70 is difficult to achieve reliably, requiring a "reverse push test" to check whether the pin is secure. Another disadvantage of the conventional design is its reliance on the face fit between end face 14 of slave piston 10 and the lower end face of plunger 20, an approach which requires that the two end faces be extremely flat.

In the clipping mechanism of this invention as shown in FIGS. 4–7, slave piston 100 reciprocates along longitudinal axis 180 within slave piston cylinder 114, contained in housing 210. Within slave piston 100 are bores 106 and 108, connected via aperture 112. Valve member 120, which is held in place against the lower end face 134 of screw 130 by spring 140, reciprocates in bore 108 along longitudinal axis 180. Valve member 120 makes a "lap fit" along wall 110 of bore 108 with slave piston 100. The slave piston system also incorporates retaining ring 170, which is used to contain valve member 120 and spring 140 within bore 108 during assembly.

The initial position of lower end face 116 of slave piston 100 with respect to the exhaust valve (not shown) that is acted upon by slave piston 100 is determined by the adjustment of lash-adjusting screw 130 and fixed by tightening nut 200. Note that hydraulic fluid in the upper region 115 of slave piston cylinder 114 flows into bore 108 both above valve member 120 and below it via slot 123 in screw 130 and via aperture 124 in valve member 120.

Figure 6:
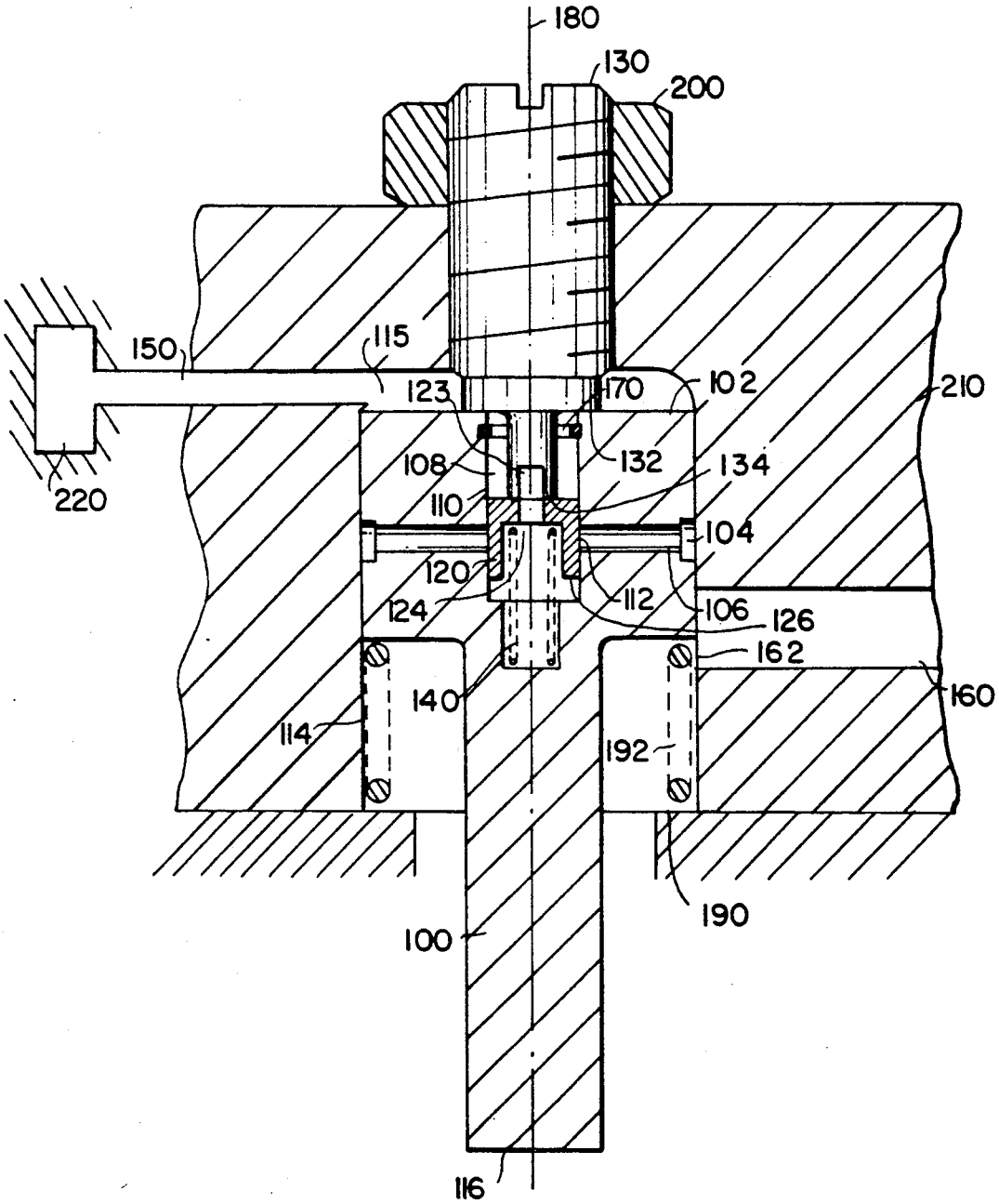
FIG. 6 is a simplified cross-sectional view of an illustrative embodiment of the self-clipping slave piston of the present invention in the closed position.

The self-clipping slave piston operates as follows: at the beginning of a cycle, when source 220 supplies relatively low pressure hydraulic fluid, the position of the elements is as shown in FIG. 6. Slave piston 100 is urged upwards against lower portion 132 of screw 130 by spring 192, which acts against support member 190. A high pressure hydraulic fluid pulse is produced by variable pressure source 220. Typically this pulse is produced as was shown in FIG. 3. The pulse is transmitted via passage 150 into upper region 115 of slave piston cylinder 114 where the resulting pressure against top end face 102 of slave piston 100 forces it in a downward direction.

Figure 7:
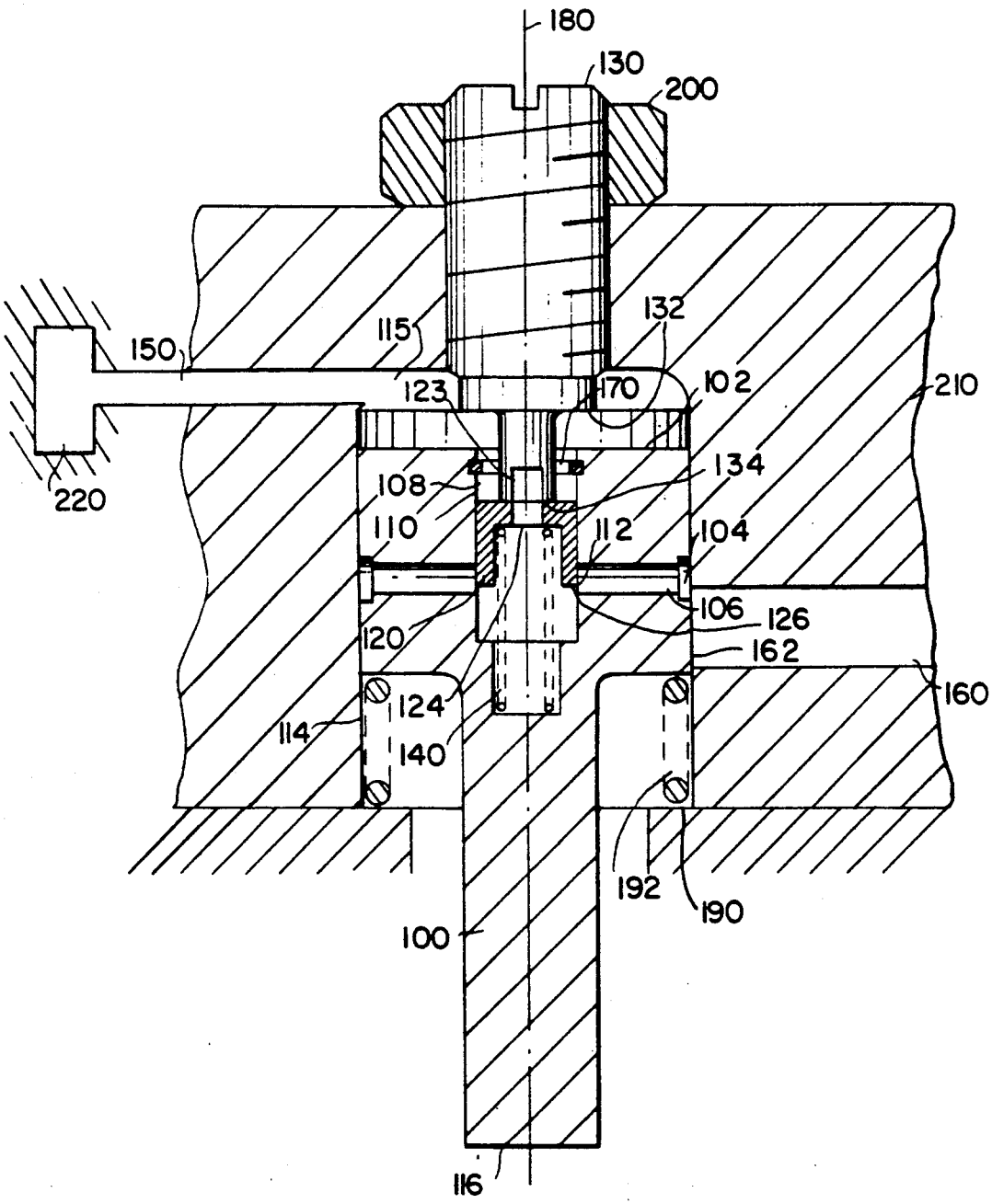
FIG. 7 is a view similar to FIG. 6 showing the self-clipping slave piston of FIG. 6 as it is opening.

Referring now to FIG. 7, as slave piston 100 moves down, valve member 120 remains in contact with the lower surface 134 of screw 130. Accordingly, the lower edge 126 of valve member 120 eventually uncovers aperture 112, which connects bore 108 with bores 106. Circumferential groove 104 in slave piston 100 and aperture 162 in housing 210 are prearranged, so that they are aligned at the same time or prior to the uncovering of aperture 112 by valve member 120. Thus, as shown in FIG. 7, when slave piston 100 has reached the position in slave piston cylinder 114 that uncovers aperture 112, high pressure hydraulic fluid can escape from bore 108 via the one of bores 106 that is aligned with passage way 160, circumferential groove 104, and passageway 160. Passageway 160 is connected to a low pressure hydraulic fluid recovery area (similar to recovery area 360, shown in FIG. 3). When the pressure on top surface 102 of slave piston 100 is reduced, spring 192 quickly forces slave piston 100 in an upward direction along longitudinal axis 180 toward its initial position in the cycle.

In contrast to the prior art slave piston arrangement described previously, the present invention overcomes the need for pin 22 while additionally providing a better lap-fit seal. In addition, the prior art hollow lash-adjusting screw 70 has been replaced in the current invention by solid screw 130.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. Apparatus for limiting the travel of a slave piston in a slave piston cylinder in a compression relief engine retarder, said cylinder being connected in a hydraulic circuit so that when hydraulic fluid is forced into said cylinder at one end of said slave piston, said slave piston moves along a longitudinal axis of said cylinder, said apparatus comprising:

a first bore disposed in said slave piston, said first bore having side walls which are substantially parallel to said longitudinal axis, said first bore communicating with said hydraulic fluid in said cylinder at said one end of said slave piston;

a second bore disposed in said slave piston, said second bore communicating with said first bore via a first aperture in the walls of said first bore;

a valve member disposed in said first bore for reciprocation relative to said slave piston substantially parallel to said longitudinal axis between (a) a closed position in which said valve member covers said first aperture and substantially prevents hydraulic fluid from flowing from said first bore into said second bore and (b) an open position in which said valve member at least partly opens said first aperture and allows hydraulic fluid to escape from said first bore via said second bore; and means for maintaining said valve member substantially in a predetermined position relative to said cylinder along said longitudinal axis so that said valve member is initially in said closed position and, after a predetermined amount of travel of said slave piston in response to the forcing of hydraulic fluid into said cylinder, is in said open position.

2. The apparatus of claim 1 wherein said second bore of said slave piston allows the hydraulic fluid to escape from said slave piston via a second aperture in an exterior wall of said slave piston.

3. The apparatus of claim 1 wherein said first bore further comprises a recess for holding a retaining ring disposed adjacent to said side walls of said first bore.

4. The apparatus of claim 1 wherein said cylinder is disposed in a housing, and wherein said apparatus further comprises a first passage in said housing, said first passage communicating with said cylinder at said one end of said slave piston, said first passage additionally communicating with a variable pressure source of hydraulic fluid.

5. The apparatus of claim 1 wherein said cylinder is disposed in a housing, and wherein the means for maintaining said valve member in said predetermined position along said longitudinal axis comprises an adjustable screw disposed adjacent to said slave piston.

6. The apparatus of claim 5 wherein said means for maintaining said valve member in said predetermined position further comprises a first spring disposed adjacent to said valve member for holding said valve member substantially against said adjustable screw.

7. The apparatus of claim 5 wherein said adjustable screw is substantially solid.

8. The apparatus of claim 5 wherein said slave piston is in a first position relative to said cylinder along said longitudinal axis when said valve member is in said closed position and said slave piston is in a second position relative to said cylinder along said longitudinal axis when said valve member is in said open position, said adjustable screw being disposed adjacent to said slave piston such that said first position is determined by the relative location of said adjustable screw along said longitudinal axis.

9. The apparatus of claim 8 wherein said slave piston is urged along said longitudinal axis toward said first position by a second spring, said second spring being disposed adjacent to said slave piston and attached to said housing.

10. The apparatus of claim 8 wherein said screw is disposed in said housing and a nut is disposed on said screw adjacent to said housing, said nut holding said adjustable screw such that said first position is substantially fixed.

11. The apparatus of claim 8 further comprising a second passage in said housing, said second passage communicating with said cylinder via a third aperture, wherein the hydraulic fluid that escapes from said first bore via said second bore further flows via said second aperture and via said third aperture into said second passage when said valve member is in said open position.

* * * * *